US008988252B2

(12) United States Patent
Scholl et al.

(10) Patent No.: US 8,988,252 B2
(45) Date of Patent: Mar. 24, 2015

(54) TRAFFIC EVENT MONITORING

(75) Inventors: Kay-Ulrich Scholl, Karlsbad (DE); Andreas Stiegler, Waldbronn (DE); Heiko Oehring, Remchingen (DE)

(73) Assignee: Harman Becker Automotive Systems GmbH, Karlsbad (DE)

( * ) Notice: Subject to any disclaimer, the term of this patent is extended or adjusted under 35 U.S.C. 154(b) by 390 days.

(21) Appl. No.: 13/271,578

(22) Filed: Oct. 12, 2011

(65) Prior Publication Data

US 2012/0092187 A1 Apr. 19, 2012

(30) Foreign Application Priority Data

Oct. 13, 2010 (EP) ..... 10 187 417

(51) Int. Cl.
*G08G 1/017* (2006.01)
*G08G 1/0967* (2006.01)
*G08G 1/04* (2006.01)

(52) U.S. Cl.
CPC ..... *G08G 1/096716* (2013.01); *G08G 1/04* (2013.01); *G08G 1/096741* (2013.01); *G08G 1/096775* (2013.01)
USPC . 340/937; 340/905; 340/539.25; 340/995.13; 348/148; 348/149

(58) Field of Classification Search
USPC ..... 340/905, 937, 995.13, 539.25, 933; 348/148, 149
See application file for complete search history.

(56) References Cited

U.S. PATENT DOCUMENTS

| | | | | |
|---|---|---|---|---|
| 5,420,794 | A * | 5/1995 | James | 701/117 |
| 6,236,336 | B1 * | 5/2001 | Oliva et al. | 340/901 |
| 7,872,593 | B1 * | 1/2011 | Rauscher et al. | 340/933 |
| 8,423,235 | B2 * | 4/2013 | Lee | 701/31.4 |
| 8,576,069 | B2 * | 11/2013 | Nadeem et al. | 340/539.25 |
| 2003/0128275 | A1 * | 7/2003 | Maguire | 348/149 |
| 2004/0252192 | A1 | 12/2004 | Adachi et al. | 348/148 |
| 2006/0271286 | A1 * | 11/2006 | Rosenberg | 701/211 |
| 2007/0088488 | A1 * | 4/2007 | Reeves et al. | 701/117 |
| 2010/0134637 | A1 | 6/2010 | Cho et al. | 348/207.11 |

FOREIGN PATENT DOCUMENTS

| | | | | |
|---|---|---|---|---|
| EP | 1 324 274 | A2 | 7/2003 | G07C 5/08 |
| WO | WO 2008/072305 | A1 | 6/2008 | G08G 1/00 |

OTHER PUBLICATIONS

European Search Report issued Jan. 24, 2011, in European Patent Application No. 10 187 417.0, 6 pgs.

* cited by examiner

*Primary Examiner* — Brent Swarthout
(74) *Attorney, Agent, or Firm* — Alleman Hall McCoy Russell & Tuttle LLP

(57) ABSTRACT

Information on a traffic event, such as a traffic accident, may be provided to a vehicle equipped with a system for performing a wireless data communication with a traffic event center. The system can determine automatically if the vehicle approaches the traffic event by receiving corresponding information in a wireless data transmission, or by a determination based on the vehicle's current position and a location of the traffic event received in a wireless data transmission. If it is determined by the system that the vehicle has approached a traffic event, the system can automatically acquire image data of the vehicle environment, and transmit the acquired image data to the traffic event center.

17 Claims, 3 Drawing Sheets

TRAFFIC EVENT MONITORING

PRIORITY CLAIM

This application claims the benefit of priority from European Patent Application No. 10 187 417.0, filed Oct. 13, 2010, which is incorporated by reference.

BACKGROUND OF THE INVENTION

1. Technical Field

The invention relates to a method of providing information on a traffic event, in particular an accident, and further to a vehicle traffic event monitoring system.

2. Related Art

Modern vehicles are often equipped with multi-media systems including a telecommunication unit for wireless communication via a telecommunication network. With the use of these communication systems, the driver or any other person inside a vehicle is able to communicate via the telecommunication network to persons outside the vehicle.

SUMMARY

A method of providing information on a traffic event, such as a traffic accident, may include automatically determining if a vehicle approaches a traffic event by receiving corresponding information in a wireless data transmission from a traffic event center. The determination may be based on the vehicle's current position and a location of the traffic event which is received in a wireless data transmission. If it is determined that the vehicle has approached a traffic event, image data of the vehicle environment may be acquired and transmitted to the traffic event center.

Other systems, methods, features and advantages will be, or will become, apparent to one with skill in the art upon examination of the following figures and detailed description. It is intended that all such additional systems, methods, features and advantages be included within this description, be within the scope of the invention, and be protected by the following claims.

BRIEF DESCRIPTION OF THE DRAWINGS

The system may be better understood with reference to the following drawings and description. The components in the figures are not necessarily to scale, emphasis instead being placed upon illustrating the principles of the invention. Moreover, in the figures, like referenced numerals designate corresponding parts throughout the different views.

DETAILED DESCRIPTION OF THE PREFERRED EMBODIMENTS

It is to be understood that the following detailed description of embodiments is given only for the purpose of illustration and is not to be taken in a limiting sense.

Figure 1:
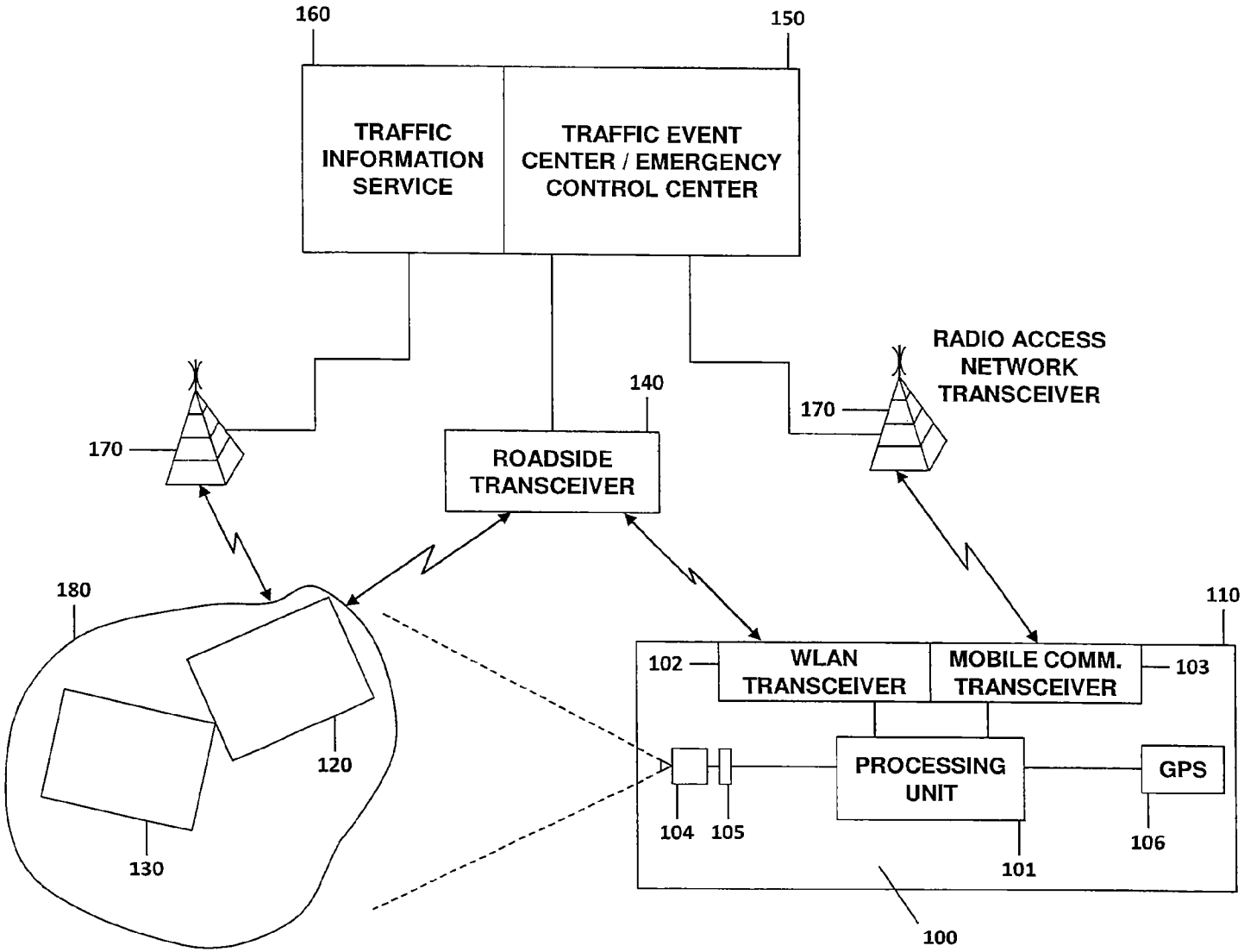
FIG. 1 schematically illustrates an example of a vehicle traffic event monitoring system in communication with a traffic event center.

It should be noted that the drawings are to be regarded as being schematic representations only, and elements in the drawings are not necessarily to scale with each other. FIG. 1 does for example only schematically illustrate the functional blocks or units, some of which may be implemented in a single physical unit, while others may as well be implemented as separate units, circuits, chips or circuit elements.

In recent years, the density of traffic has been increasing, resulting in the occurrence of a considerable number of accidents. When an accident occurs, it is generally very difficult to obtain accident related information, such as the number of vehicles or persons involved in the accident, the severity of the accident and the like directly after the occurrence of the accident. Detailed information is generally required by the authorities in order to take the appropriate measures. In the case of injured people, time may be a crucial factor, and it may be necessary to provide all the information needed to correctly react to the particular situation. It is not only important to inform the authorities as fast as possible after the accident, but also to provide such detailed information.

Authorities are generally informed of an accident by a person involved in the accident or by a third person calling the authorities by means of a mobile phone. Although this is the way the authorities are informed, a large majority of people are not able to correctly identify the location of the accident and to provide further information such as the number of injured people and the severity of the injury. This is particularly true if the persons involved in the accident have experienced a shock and are thus not capable of providing the information.

Modern vehicles may be equipped with multi-media systems including a telecommunication unit for wireless communication via a telecommunication network. With the use of these communication systems, the driver or any other person inside a vehicle may be able to communicate via the telecommunication network to persons outside the vehicle.

It may be desirable to enable the transmission of useful information relating to an accident to the authorities, and in particular to provide the authorities with useful image data of the accident site. A system may be configured to automatically inform the authorities of the occurrence of an accident. The accident can be detected by means of a sensor arranged inside a vehicle involved in the accident and corresponding information can be transmitted to the authorities via a wireless communication system. Images acquired by one of the vehicles also may be transmitted to an emergency control center in order to provide more detailed information on the accident.

Such systems may improve the response time and the information available to the authorities. However, a unit provided in one of the vehicles for acquiring such images may be destroyed during the accident. Furthermore, such a unit, e.g. a camera, may face away from the actual accident scene and may not be able to record any useful information. In particular, it may not be possible for the camera to monitor the whole accident scene. Furthermore, other electrical components of the vehicle, such as the power supply or the communication system may be affected by the accident and may no longer work properly. The transmission of the accident related information may thus be prevented.

In one example, a method of providing information on a traffic event, in particular an accident, may be performed in a vehicle equipped with a system adapted to perform a wireless data communication with a traffic event center. A traffic event may be a traffic accident, a traffic jam, a lane closure or restriction, a road construction site, a traffic diversion, a weather event (e.g., a storm, a flood, a tornado, or any other weather related event), any other event to which emergency responders (e.g., police, firemen, or paramedics) may respond, or any other event that may impact the flow of traffic along a travel route. In one example, the traffic event center may be a location from which traffic on the various roadways in a specified region is monitored and/or controlled. In another example, the traffic event center may be any unit capable of transmitting, receiving, and/or processing information related to traffic and/or a traffic event. The traffic event center may be a specialized center configured to transmit and/or receive information related only to traffic events. Alternatively, the traffic event center may be part of an information center configured to transmit and/or receive any other type of information. For example, the information center may transmit and/or receive data related to weather, vehicle navigation, mobile telephone service, vehicle security, vehicle diagnostics, or any other type of information. The method may include automatically determining if the vehicle approaches a traffic event by receiving corresponding information in a wireless data transmission. Additionally or alternatively, the determination may be based on the vehicle's current position and a location of the traffic event which is received in a wireless data transmission. If it is determined that the vehicle has approached a traffic event, the following steps may be automatically performed: image data of the vehicle environment is acquired and the acquired image data is transmitted to the traffic event center.

The method may thus be performed in another vehicle which passes by the traffic event, e.g. the accident site. As the vehicle receives over a wireless data transmission information on the location of the traffic event or that the traffic event is currently being approached, it is possible to automatically acquire and transmit image data of the traffic event, e.g. of an accident site. It may, for example, be determined that the vehicle has approached the traffic event if the vehicle comes to within a predetermined position of the traffic event. The traffic event center, which may be located at the local authorities or a centralized location, e.g. an emergency control center, may be thus provided with up-to-date images of the traffic event. The emergency control center may be a centralized location configured to transmit and/or receive information related to various emergency situations (e.g., traffic events, weather events, crimes, fires, natural disasters, or other emergency situations). For example, the emergency control center may be a center in which operators receive and respond to emergency calls (e.g., calls to an emergency telephone number such as 911) from members of the public. As the images can be provided by a third vehicle passing by the accident scene (e.g., a vehicle which was not involved in the accident or other traffic event), images of the whole scene can be acquired and furthermore, it may be ensured that the image acquisition and data transmission equipment is operating properly. The traffic event center can thus be provided with more detailed and more relevant information.

In one example, the information indicating that the vehicle is approaching the traffic event may be received from a roadside infrastructure. Such an infrastructure may be provided next to the road in order to perform a data communication with vehicles passing by. Such a roadside infrastructure may, for example, locally broadcast that the traffic event is located nearby, e.g. within a certain distance of the location of the roadside infrastructure. Vehicles passing by may thus be warned of the traffic event and the acquisition and transmission of image data can be initiated in the vehicle.

In another example, the determination that the vehicle is approaching a traffic event may include the receiving of information on a location of the traffic event by means of a wireless data transmission from a traffic information service, the traffic event center, or any other source of traffic information. The current position of the vehicle may then be determined. By comparing the vehicle's current position to the location of the traffic event, it may then automatically be determined if the vehicle approaches the traffic event. The current vehicle position may be determined from a sensor provided in the vehicle or from data received by a wireless transmission. It may thus be determined that the vehicle passes by an accident site even without the presence of roadside infrastructure.

Furthermore, control instructions may be received from the traffic event center which are configured to control the acquisition of the image data. In particular, the control instructions may be configured to control the field of view of the image acquisition. Images may be acquired with a camera, the viewing angle and orientation of which may be automatically adjusted. The control instructions may thus include instructions for adjusting camera orientation and/or viewing angle.

The acquired image data may first be stored at the vehicle before transmission to the traffic event center. It may, for example, be processed, e.g. regarding frame size or compression, or may be evaluated, e.g. with respect to image contents, before being transmitted to the event center. Data not including any useful information may, for example, not be transmitted.

It also may be possible to acquire the image data continuously for a certain period of time and to stream the acquired image data to the traffic event center. The image data may of course be compressed before streaming. The traffic event center may thus be provided with a "live image" of the traffic event scene. It should be recognized that the frame rate of such a stream may depend on the available data transmission rate, and may accordingly be rather low. High bandwidth data transmissions may provide faster frame rates.

The system can include (and the method can utilize) a vehicle to infrastructure communication (e.g. car2X communication), as part of which information on the traffic event may be received and the acquired image data may be transmitted. Different vehicles and/or roadside infrastructures may be configured as nodes in the car2x communication system. Thus, the car2X communication system may be a communication network in which vehicles and roadside infrastructures may be configured to transmit data signals to one another.

For example, the method may further include the step of establishing a wireless network connection for transmitting the acquired image data to the traffic event center, in particular a wireless local area network connection. Such a connection may be established to a roadside access point, being, e.g., part of roadside infrastructure. Such a network connection may enable a high bandwidth transmission of data. As an example, an adhoc network may be established. Such a network may be established between the vehicle and roadside infrastructure, or between plural vehicles.

It also may be possible to transmit the acquired image data via a mobile communication network. Such a mobile communication network may work according to the GSM (Global System for Mobile Communications), GPRS (General Package Radio Service), EDGE (Enhanced Data Rates for GSM Evolution), UMTS (Universal Mobile Telecommunication System), LTE (Long-Term Evolution), or any other standard. The acquired image data may thus be transmitted even without the presence of roadside infrastructure. Such telecommunication networks cover most rural and urban areas, so that the transmission of the acquired image data may be possible at most locations of the road network. Furthermore, such mobile communication networks may provide a high bandwidth data transmission.

With the acquired image data, a current vehicle position may be transmitted to the traffic event center. Localization of the traffic event may thus be improved. As an example, if the information on the location of the traffic event only includes the information that it is located on a particular stretch of road, then the transmission of such information (e.g., the current vehicle position) can help to more precisely locate the traffic event.

The traffic information service may, for example, be provided by the traffic event center, so that the information on a location of the traffic event may be received from the traffic event center. The traffic event center may thus centrally coordinate the transmission of information on the traffic event and the collection of the acquired image data.

In another example, a vehicle traffic event monitoring system may include a receiving unit adapted to receive by wireless transmission information regarding a traffic event, in particular an accident, and an image sensor adapted to monitor the vehicle environment. A transmitting unit of the system may be adapted to perform a wireless data communication with a traffic event center. The system further may include a processing unit adapted to determine automatically if the vehicle approaches the traffic event by receiving corresponding information in a wireless data transmission by means of the receiver or by a determination based on the vehicle's current position and a location of the traffic event received in a wireless data transmission by means of the receiver. The processing unit also may be adapted to acquire image data of the vehicle environment by means of the image sensor and to transmit the acquired image data to the traffic event center by means of the transmitter if it is determined that the vehicle has approached the traffic event. With the vehicle traffic event monitoring system according to this example, advantages similar to those outlined further above may be achieved.

In one example, the system may determine that the vehicle has approached the traffic event if the vehicle comes to within a predetermined distance of the traffic event. The receiver may be adapted to receive by a wireless data transmission from a traffic information service information on a location of the traffic event. The system may further include a position determination unit adapted to determine the current position of the vehicle. The processing unit may perform the determination if the vehicle approaches the traffic event automatically by comparing the vehicle's current position to the location of the traffic event.

In other examples, it also may be possible that the position of the vehicle is determined outside the vehicle and then transmitted to the vehicle by means of the wireless data communication. As an example, signals from a cellular communication network may be used and evaluated inside the vehicle, e.g. by geometric methods, such as triangulation, in order to determine the vehicle's current position. Such a determination may also be made outside the vehicle based on signals transmitted to the cellular communication network by a transmitter located inside the vehicle. It may be determined in which cell of the communication network the vehicle is located, or more precisely at which approximate position in the cell, information of which may then be transmitted to the vehicle over the communication network.

The current position may also be received from the roadside infrastructure, e.g. from a roadside transmitter which may transmit position information.

The position determination unit may include a Global Positioning System (GPS) sensor and/or means for determining the vehicle position on the basis of a signal received from a mobile communication network. It may also include both a GPS sensor and means for determining the vehicle position on the basis of a signal received from a mobile communication network, so that in case one means for determining the position is unavailable, the system may switch over to the other means for determining the position.

The system may further include an image sensor controller adapted to control the field of view of the image sensor in accordance with image control instruction received from the traffic event center. As an example, the image sensor may be a camera, and the controller may adjust the panning and the focal length of the camera. If the traffic event center requires, for example, more information on a particular region or section of an accident site, the controller may adjust the image sensor accordingly so as to capture the required information.

The system may further include streaming means for streaming the acquired image data to the traffic event center. The streaming means may, for example, be implemented by a streaming server running on a processing unit of the traffic event monitoring system of the vehicle.

The receiving unit and/or the transmitting unit may work according to at least one of the following standards: a wireless local area network (WLAN) standard, a mobile telephony standard, Global System for Mobile Communications (GSM), General Packet Radio Service (GPRS), Universal Mobile Telecommunications System (UMTS), Enhanced Data Rates for GSM Evolution (EDGE), Long Term Evolution (LTE), Bluetooth, Digital Video Broadcasting Terrestrial (DVBT), Radio Data System (RDS), Traffic Message Channel (TMC), or any other standard for transmitting and/or receiving data. It should be clear that a plurality of receivers and/or transmitters may be provided working according to any combination of the above mentioned standards. Furthermore, a receiver and transmitter may be combined in a transceiver, i.e. the transceiver operates both as a receiving unit and as a transmitting unit. While, for example, information on the location of the traffic event may be received by systems, such as DVBT, RDS, or TMC, which may only enable the receiving of information at the vehicle, transmission of acquired image data may occur by a system enabling a higher bandwidth transmission, such as WLAN, UMTS, EDGE, or LTE.

The image sensor may be an image sensor of a driver assistance system. For example, the image sensor may be a camera or a 3D camera, such as a photonic mixer device. Only one image sensor may need to be provided for both the traffic event monitoring and driver assistance systems, resulting in decreased manufacturing costs.

The processing unit may further be adapted to transmit with the acquired image data a current vehicle position to the traffic event center by means of the transmitter. More detailed information on the location of the traffic event may thus be available at the traffic event center.

The system also may be implemented so as to perform any of the method steps mentioned above. Similarly, the method may make use of any of the components of the vehicle traffic event monitoring system described above.

It is to be understood that the features mentioned above and those to be explained below can be used not only in the respective combinations indicated, but also in other combinations or in isolation, without leaving the scope of the present invention.

FIG. 1 illustrates an example of a vehicle traffic event monitoring system 100 installed in a first vehicle 110. System 100 is configured to automatically record images or video streams of an accident site if vehicle 110 passes the accident site. The recorded information is transmitted to the traffic event center 150, which may, for example, be an emergency control center evaluating the received data in order to estimate the severity of the accident.

For this purpose, system 100 may include a processing unit 101 controlling the operation of the system. The processing unit 101 may include components such as a central processing unit (CPU), a graphics processing unit (GPU), or both. For example, processing unit 101 may include one or more general processors or microprocessors, application specific integrated circuits (ASICs), digital signal processors (DSPs), field programmable gate arrays, servers, networks, digital circuits, analog circuits, combinations thereof, or other now known or later developed devices for analyzing and processing data. The processing unit 101 may implement a software program, such as code generated manually (i.e., programmed).

The term "module" may be defined to include one or more executable modules. As described herein, the modules are defined to include software, hardware or some combination executable by a processor, such as processing unit 101. Software may include instructions stored in memory that are executable by the processing unit 101 or other processor. Hardware may include various devices, components, circuits, gates, circuit boards, and the like that are executable, directed, and/or controlled for performance by the processing unit 101.

The processing unit 101 may further include memory for storing program control instructions for operating system 100. The memory may be a main memory, a static memory, or a dynamic memory. The memory may include all types of memory, such as computer readable storage media such as various types of volatile and non-volatile storage media, including, but not limited to, random access memory, read only memory, programmable read-only memory, electrically programmable read-only memory, electrically erasable read-only memory, flash memory, magnetic tape or disk, a hard drive, optical media or the like. In one example, the memory may include a cache or random access memory for the processing unit 101. In alternative examples, the memory may be separate from the processing unit 101, such as a cache memory of a processor, the system memory, or other memory. The memory may be an external storage device or database for storing data. Examples include a hard drive, compact disc ("CD"), digital video disc ("DVD"), memory card, memory stick, floppy disc, universal serial bus ("USB") memory device, or any other device operative to store data. The memory may be operable to store instructions executable by the processing unit 101. The functions, acts or tasks illustrated in the figures or described may be performed and/or controlled and/or directed by the programmed processing unit 101 executing the instructions stored in the memory. The functions, acts or tasks are independent of the particular type of instructions set, storage media, processor or processing strategy and may be performed by software, hardware, integrated circuits, firm-ware, micro-code and the like, operating alone or in combination. Likewise, processing strategies may include multiprocessing, multitasking, parallel processing and the like.

This memory may also be used to temporarily or more permanently store acquired image data or video sequences recorded with the image sensor 104. Processing unit 101 may for example operate programs adapted to control the communication via the provided WLAN transceiver 102 or mobile communication transceiver 103, and may further operate programs for controlling the operation of image sensor 104.

For this purpose, an image sensor controller 105 may be provided, which may receive control instructions from the processing unit 101. These control instructions may be generated by the processing unit 101 itself or may be received over a wireless data communication by means of one of the transceivers 102 or 103. Image sensor controller 105 may include mechanical components for adjusting the orientation and thus viewing direction of image sensor 104, e.g. for panning the image sensor 104. It may further include components for adjusting the aperture angle of the image sensor 104, e.g. by adjusting the focal length of a lens of the image sensor. Other functions that may be controlled include the start and stop of the image acquisition or capturing of a video sequence, the resolution or image quality of such image data or video sequence, and further parameters common to imaging systems, such as exposure, and the like. As such, image sensor 104 and image sensor controller 105 may be implemented within a single unit.

The present disclosure contemplates a computer-readable medium that includes instructions or receives and executes instructions responsive to a propagated signal so that a device connected to a network can communicate voice, video, audio, images or any other data over the network. Further, the instructions may be transmitted or received over the network via a communication port or interface (e.g., transceiver 102 or 103), and/or using a bus. The communication port or interface may be a part of the processing unit 101 or may be a separate component. The communication port may be created in software and may include a physical connection in hardware. The communication port may be configured to connect with a network, external media, display, or any other components in system 100, or combinations thereof. The connection with the network may be a physical connection, such as a wired Ethernet connection or may be established wirelessly. Likewise, the additional connections with other components of the system 100 may be physical connections or may be established wirelessly. The network may alternatively be directly connected to the bus.

The term "computer-readable medium" may include a single medium or multiple media, such as a centralized or distributed database, and/or associated caches and servers that store one or more sets of instructions and data. The term "computer-readable medium" may also include any medium that is capable of storing, encoding or carrying data and/or a set of instructions for execution by a processor or that cause a computer system to perform any one or more of the methods or operations disclosed. The "computer-readable medium" is non-transitory, and is tangible.

In an example, the computer-readable medium can include a solid-state memory such as a memory card or other integrated circuit package that houses one or more non-volatile read-only memories. Further, the computer-readable medium can be a random access memory or other volatile re-writable memory. Additionally, the computer-readable medium can include a magneto-optical or optical medium, such as a disk or tapes or other storage device to capture carrier wave signals such as a signal communicated over a transmission medium. A digital file attachment to an e-mail or other self-contained information archive or set of archives may be considered a distribution medium that is a tangible storage medium. Accordingly, the disclosure is considered to include any one or more of a computer-readable medium or a distribution medium and other equivalents and successor media, in which data or instructions may be stored.

In an alternative example, dedicated hardware implementations, such as application specific integrated circuits, programmable logic arrays and other hardware devices, can be constructed to implement various modules or parts of modules included in the system. Applications that may include the apparatus and systems can broadly include a variety of electronic and computer systems. One or more examples described may implement functions using two or more specific interconnected hardware modules or devices with related control and data signals that can be communicated between and through the modules, or as portions of an application-specific integrated circuit. Accordingly, the present system encompasses software, firmware, and hardware implementations.

The system described may be at least partially implemented by software programs executable by a computer system. Further, in a non-limited example, implementations can include distributed processing, component/object distributed processing, and parallel processing. Alternatively, virtual computer system processing, such as cloud computing, can be constructed to implement at least some of the various parts of the system.

A network may include wired networks, wireless networks, Ethernet AVB networks, or combinations thereof. The wireless network may be a cellular telephone network, an 802.11, 802.16, 802.20, 802.1Q or WiMax network. Further, the network may be a public network, such as the Internet, a private network, such as an intranet, or combinations thereof, and may utilize a variety of networking protocols now available or later developed including, but not limited to TCP/IP based networking protocols.

Image sensor 104 may monitor an area in the surroundings of the vehicle 110. Image sensor 104 may, for example, be mounted in the vehicle 110 so as to monitor the area in front of the vehicle, behind the vehicle or on one or the other side of the vehicle. It should be clear that further image sensors 104 and controllers 105 may be provided in the system 100, so as to monitor different areas in the surroundings of the vehicle. As an example, image sensor 104 may be mounted in the rearview mirror or exterior mirror of the vehicle 110.

In a particular example, image sensor 104 is a sensor of a driver assistance system mounted to vehicle 110. Such a system may, for example, be an adaptive cruise control system, a pre-crash control system, or a park assistance system. Image sensor 104 can be a camera such as a CCD or CMOS camera. Other implementations may include a 3D camera, such as a PMD. The image sensor may be installed behind the windshield for monitoring the area in front of the vehicle or may be provided behind the radiator grill in the front part of the vehicle 110. It should be understood that the image sensor can be provided at different locations in the vehicle.

System 100 further may include a position determination unit 106, which may be a GPS system as shown in FIG. 1. Position determination unit 106 can provide processing unit 101 with current information on the position of vehicle 110. The position determination unit 106 may also be implemented with other means, e.g. with a system adapted to evaluate a signal received by means of the mobile communication transceiver 103. By means of signals received from different mobile communication network transceivers, the current position may be determined by a geometrical method, such as triangulation. For example, two mobile communication network transceivers and vehicle 110 may form the vertices of a triangle. The distance between the two mobile communication network transceivers may be known. An angle between each mobile communication network transceiver and vehicle 110 may be detected, and a distance between vehicle 110 and each mobile communication network transceiver may be calculated based on the known distance between the mobile communication network transceivers and the detected angles. Alternatively, a distance between vehicle 110 and each mobile communication network transceiver may be detected, and an angle between each mobile communication network transceiver and vehicle 110 may be calculated. In this manner, the position of vehicle 110 relative to the two mobile communication network transceivers may be determined. Such a system may be implemented by processing unit 101 or additional components may be provided for performing such a position determination.

System 100 further may include the transceivers 102 and 103 adapted to perform a wireless data communication. It should be clear that only one of these transceivers may be provided or that other types of transceivers, such as mentioned above, may be provided separately or in combination with these transceivers. Processing unit 101 can transmit and receive data by means of these transceivers 102 and 103.

WLAN transceiver 102 may, for example, establish a network connection (e.g. adhoc connection) to a roadside transceiver 140. Such a transceiver may be mounted in traffic infrastructure, e.g. at crossings and the like. Establishing a WLAN connection has the advantage that high transmission bandwidths may be achieved. In particular, at locations in the road network at which it is known that accidents occur with a high frequency, such transceivers may be installed. By means of such a WLAN connection, system 100 may receive from roadside transceiver 140 the information or a warning that vehicle 110 is approaching a traffic event, e.g. the site of an accident. System 100 may further receive information on the current position of vehicle 110. This may be possible as the range of roadside transceiver 140 may be rather limited, so that by receiving the corresponding WLAN signal, the position of vehicle 110 can be determined rather precisely. It should be clear that 'roadside' does not mean that the transceiver needs to be provided next to the road, but only in such proximity to the road that vehicle 110 may receive the signal provided by transceiver 140 for establishing the WLAN connection.

As WLAN connections generally have a high data transmission bandwidth, system 100 can transfer recorded image data and/or video sequences by the WLAN connection and WLAN transceiver 140 to the traffic event center 150, e.g. via an IP-network. Similarly, traffic information system 160 may send over such network connection information on the location of a traffic event to system 100, and traffic event center 150 may send information in the form of control instructions to system 100 in order to control the controller 105 of image sensor 104.

The wireless data communication mentioned above may also be performed by other wireless data communications, e.g. communication over a mobile telecommunications network. To this purpose, mobile communication transceiver 103 may be provided and may interface processing unit 101. Mobile communication transceiver 103 may be in communication with a radio access network transceiver 170. It is not important what type of mobile communication network is used for the communication between traffic event center 150 and system 100, as long as the transmission of the data is enabled. For the transmission of the acquired image data or video sequences, a high bandwidth communication is preferred, e.g. over EDGE, UMTS or LTE. Transceiver 170 schematically represents the transceiver of the radio access network of any such mobile communication networks. It should be clear that the communication with traffic event center 150 may occur via more components of the telecommunication network, such as access network controllers, gateways, core networks and the like, which not illustrated in further detail here.

Traffic information service 160 and traffic event center 150 may be different centers, or may be integrated within a single center. Traffic information service 160 may receive from information sources information relating to the occurrence of traffic events. Such information sources may be communication or data transmission systems provided in other vehicles, local authorities such as police, fire departments or emergency services, or other persons or systems providing such traffic-related information. FIG. 1 schematically illustrates, as an example, the occurrence of an accident between the two vehicles 120 and 130. Vehicle 120 may be provided with an emergency button which is operated by the driver of the vehicle and upon which an emergency system of the vehicle establishes wireless data communication with the center 150 or 160. Vehicle 120 thus provides the information that the accident occurred and further information about the location of the accident. The persons passing by the accident may, furthermore, using a cell phone, call centers 150 or 160 to provide corresponding information if available. Such information may also be transmitted to roadside infrastructure 140 either by direct transmission from vehicle 120 or 130 or by means of a data communication between one of the centers 150 and 160 and roadside infrastructure 140.

Vehicle to X communication (in particular car2X communication) may be used to inform system 100 about the occurrence of the traffic event, here the accident between vehicles 120 and 130. System 100 thus obtains knowledge of passing the traffic event and thus initiates the recording of data by means of image sensor 104. System 100 can determine that vehicle 110 is currently passing the traffic event as follows: system 100 can receive the information that vehicle 100 has approached the traffic event directly from roadside transceiver 140. System 100 may additionally or alternatively receive the location of the traffic event from the traffic information service 160 or from the roadside infrastructure 140. In the example illustrated in FIG. 1, the information may be, for example, received over the mobile telecommunication network or the WLAN connection. It should be clear that such information can be received in a variety of ways, e.g. via an RDS or a TMC transmission, a DVBT transmission, or any other type of wireless data communication.

System 100 can now compare the received location of the traffic event with the current vehicle position determined from unit 106 in order to determine that vehicle 110 has approached the traffic event (e.g., that vehicle 110 is within a pre-defined distance of the traffic event). The current position can additionally or alternatively be received over one of the wireless data communications as mentioned above.

Once it is determined that the vehicle has approached the traffic event, processing unit 101 may control image sensor 104 to acquire images or a video sequence of the traffic event. In the example of FIG. 1, image sensor 104 may capture a video sequence of the accident of vehicle 120 and 130 when passing by the accident site. The acquired image data then may be transmitted to traffic event center 150, e.g. via the WLAN connection or over the mobile telecommunication network, e.g. via a packet-based transmission. Additionally or alternatively, processing unit 101 may control image sensor 104 to acquire a stream of video data, which may be transmitted to the traffic event center 150 preferably via a high bandwidth connection or communication.

Traffic event center 150 can now evaluate the received image data and take the appropriate measures, e.g. decide on the necessity of a fire vehicle or the number of required ambulances.

As vehicle 110 passes by the accident scene, image sensor 104 may be capable of covering the whole accident scene, so that comprehensive information is available at traffic event center 150. If different information is required, traffic event center 150 can inform the driver of vehicle 110, e.g. via a data transmission through system 100 or it can directly control the operation of image sensor 104 by the transmission of corresponding control instructions to system 100, as described further above. Traffic event center 150 may thus zoom in on a particular detail of the accident scene or may point the camera to a particular section of the scene.

Processing unit 101 can be configured to take further measures when it receives the information or determines that the vehicle is approaching the traffic event, i.e. comes to within a certain distance of the traffic event. Such measures can be one or a combination of the following: The driver of the vehicle can be warned by means of an acoustic and/or visual signal indicating the approaching of the traffic event. If the processing unit 101 is adapted to automatically start the recording and transmission of the image data, the processing unit may inform the driver that recording and/or transmission have started. The driver may be given the possibility of controlling the acquisition and/or transmission of the image data. The driver may, for example, select via a user interface provided for the system 100 not to transmit or not to acquire the image data. Privacy aspects of the driver or other vehicle passengers may thus be accounted for. In other examples, it is also conceivable that the driver may take a more interactive role in the acquisition and/or transmission of image data, e.g. by initiating the acquisition and/or transmission, by aiming the image sensor at a particular area of the traffic event site, by selecting the mode or system to be used for data transmission and the like.

As a particular example, system 100 may give out the information that the vehicle is approaching an accident scene and may prompt the driver to indicate whether image data should be acquired and transmitted (e.g. by means of a voice output or by displaying a corresponding message on a display means). The driver can now enter, via a mechanical or graphical control element or a voice command, the instruction "allow transmission" or "deny transmission" into system 100 which is configured to act accordingly. The system may thus have the further advantages that the driver is warned of the upcoming traffic event and that the driver's privacy can be protected.

The display means may include any type of display unit, such as a liquid crystal display (LCD), an organic light emitting diode (OLED), a flat panel display, a solid state display, a cathode ray tube (CRT), a projector, a printer or other now known or later developed display device for outputting determined information. The display may act as an interface for the user to see the functioning of the processor, or specifically as an interface with software stored in memory or in a computer-readable medium.

System 100 may include an input device configured to allow a user to interact with any of the components of system 100. For example, the input device may enable the driver to enter instructions as described above. The input device may be a number pad, a keyboard, or a cursor control device, such as a mouse, or a joystick, touch screen display, remote control or any other device operative to interact with the system 100.

Figure 2:
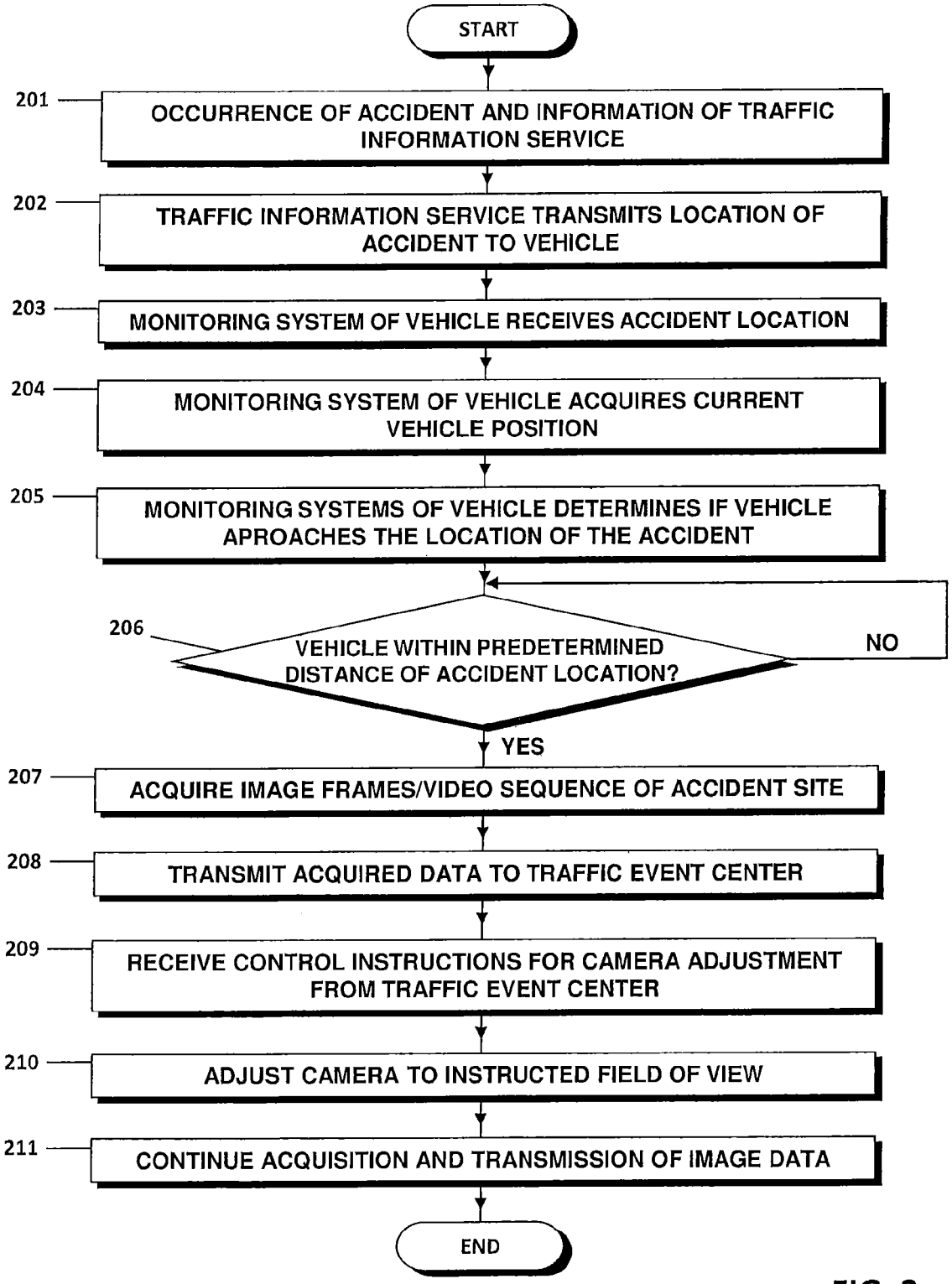
FIG. 2 shows a flow diagram illustrating an example of a method for monitoring a traffic event.

The flow diagram of FIG. 2 illustrates steps of one example of a method which may be performed by the system 100 illustrated in FIG. 1. While the method is described with respect to an accident, it should be clear that the method can be performed similarly for other types of traffic events for which the transmission of the information to the traffic event center may be beneficial, e.g. the blocking of a road by an environmental event such as a mudslide or the like.

In step 201, a traffic accident (or other traffic event) occurs and the traffic information service is informed of the traffic accident, e.g. by one of the involved persons or vehicles, or by a third person or the like. The traffic information service may transmit the location of the accident to the vehicle 110 in step 202. The monitoring system 100 of vehicle 110 may receive the accident location in step 203. The monitoring system 100 may acquire in step 204 the current vehicle position of vehicle 110 from the position determination unit 106. In step 205, the monitoring system 100 of the vehicle 110 may determine if the vehicle approaches the location of the accident.

It should be clear that the system 100 may also receive the information on the location of a plurality of traffic events, so that the system can continuously monitor if one of these traffic events is approached. If in decision step 206 it is determined that the vehicle is not within a pre-determined distance of the location of the accident, monitoring continues in step 205.

If the vehicle comes to within the pre-determined distance, image frames and/or video sequences of the accident site may be acquired in step 207. It should be clear that as the image sensor 104 may be part of another vehicle system, image acquisition may have already been started before step 207, e.g. in order to provide such a system with image data. For example, image acquisition may have been initiated by a driver assistance system prior to vehicle 110 coming to within the pre-determined distance of the accident.

The acquired data may be transmitted in step 208 to the traffic event center 150. This can occur by any of the above described means, for example, over a WLAN connection or via a mobile communication network. System 100 may in step 209 receive control instructions for adjusting the image sensor, e.g. a camera, from the traffic event center. The camera may be adjusted according to the instructions in step 210. Data acquisition then may be continued and the image data may be transmitted to the traffic event center (step 211). Traffic event center 150 may now take the appropriate measures.

It should be noted that some of the steps illustrated in FIG. 2 may be optional, e.g. steps 209 to 211. Furthermore, it should be clear that the method may include further steps, e.g. those mentioned above with respect to FIG. 1.

Figure 3:
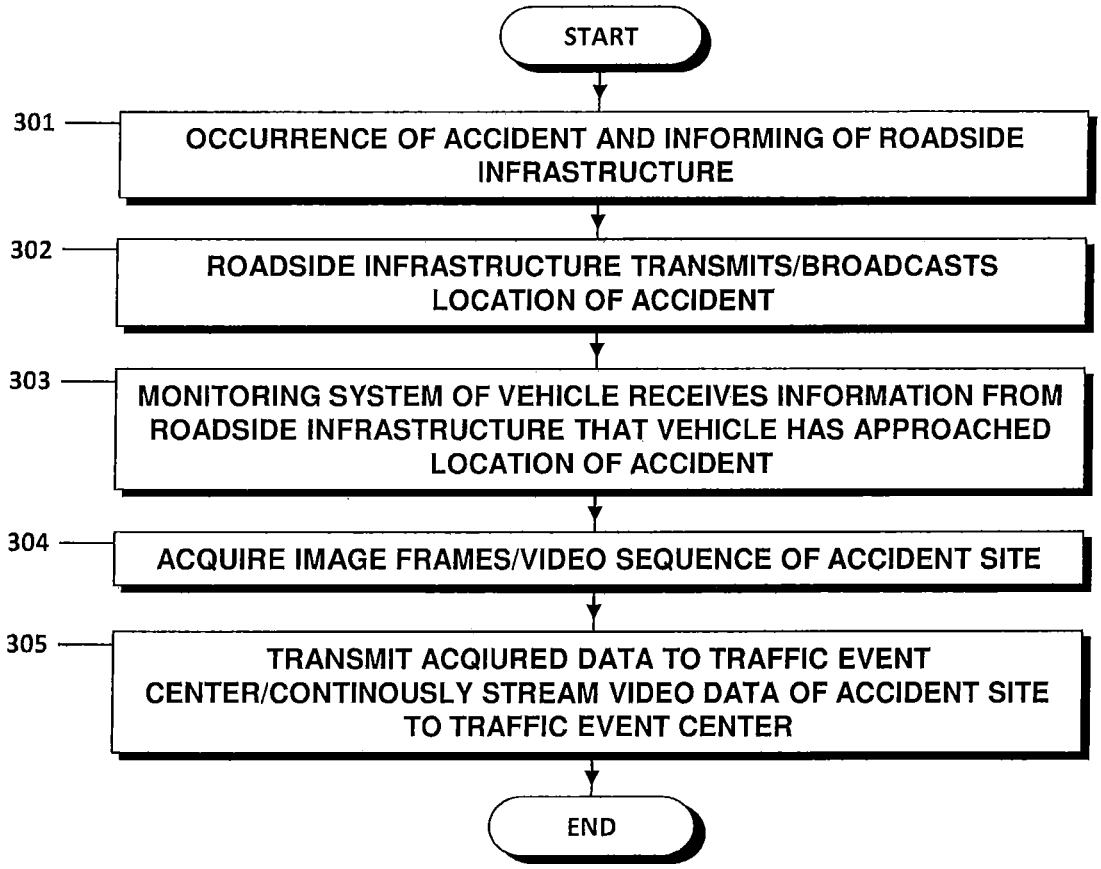
FIG. 3 shows a flow diagram illustrating an example of a method for monitoring a traffic event.

FIG. 3 shows another flow diagram illustrating another example of a method which may be performed by system 100 illustrated in FIG. 1. In step 301, an accident (or any other traffic event) occurs and the roadside infrastructure 140 may be informed via traffic information service 160 or directly by one of the vehicles involved in the accident. The roadside infrastructure 140 may transmit or broadcast, e.g. via some type of multi-cast, the location of the accident to vehicles within the reach of the roadside infrastructure (step 302). The vehicles within the reach of the roadside infrastructure may include any vehicles capable of receiving a signal transmitted by the roadside infrastructure. Alternatively, or additionally, the vehicles within the reach of the roadside infrastructure may include any vehicles within a determined distance of the roadside infrastructure. Vehicles passing the roadside infrastructure 140 can thus directly determine that they have approached the traffic event, or may make such a determination based on the accident location and current vehicle position.

In the example of FIG. 3, the monitoring system 100 of the vehicle 110 may receive information from the roadside infrastructure 140 that the vehicle has approached the location of the accident (step 303). System 100 then may start the acquisition of the image frames and/or video sequences of the accident site with the image sensor 104 in step 304. Again, the acquired data may be transmitted to the traffic event center 150, e.g. as separate data transmission or as a continuous stream of video data, in step 305. The traffic event center again now may have the required information available for determining further measures that may be taken.

It should again be clear that the method illustrated in FIG. 3 may include further steps, e.g. steps 209 to 211 explained above with respect to FIG. 2. Steps of the examples of the methods illustrated with respect to FIG. 2 and FIG. 3 may certainly be combined.

By implementing the above systems or methods, vehicles that pass accident sites can automatically record data, in particular video sequences, and transmit the data to a central accident registration office, such as the above mentioned traffic event center 150. By making use of car2X communication which may be provided in a plurality of modern vehicles, the recording of the data can be initiated automatically, as the monitoring system may have knowledge about the passing of the accident site. By recording the scene using sensors already available in the vehicle, such as a video camera of a driver assistance system, the monitoring system can be implemented cost-efficiently in the vehicle. Using the above mentioned data communication means, it may be possible to transmit separate images or video sequences to the traffic control center 150, or to perform a video streaming to the center. The traffic event center 150 can thus be provided with a better overview of the severity of the accident, and may be enabled to react accordingly. It may, for example, determine how many ambulances and whether a fire brigade should be sent to the site of the accident. Reaction time and response efficiency may thus be improved.

While specific embodiments of the invention are disclosed herein, various changes and modifications can be made without departing from the scope of the invention. As an example, car to car communication may be used for transmitting information relating to the occurrence of the traffic event or for transmitting acquired image or video data.

While various embodiments of the invention have been described, it will be apparent to those of ordinary skill in the art that many more embodiments and implementations are possible within the scope of the invention. Accordingly, the invention is not to be restricted except in light of the attached claims and their equivalents.

We claim:

1. A method of providing information on a traffic event, the method being performed in a vehicle equipped with a system for performing a wireless data communication with a traffic event center, the method comprising the steps of:

determining automatically with a processor of the vehicle that the vehicle is approaching the traffic event based on a current position of the vehicle and a location of the traffic event by receiving a wireless data transmission;

receiving control instructions, one or more of the control instructions being received from the traffic event center; and in response to determining that the vehicle is approaching the traffic event, acquiring image data of a vehicle environment with an image sensor and informing the user that the vehicle is approaching the traffic event;

controlling the acquisition of the image data according to the received control instructions, where controlling the acquisition of the image data comprises controlling a field of view of the image sensor according to the control instructions received from the traffic event center;

retrieving a user input; and selectively transmitting the acquired image data for receipt by the traffic event center depending on the user input.

2. The method according to claim 1, where determining automatically that the vehicle is approaching the traffic event comprises receiving the wireless data transmission from a roadside infrastructure.

3. The method according to claim 1, where determining automatically that the vehicle is approaching the traffic event comprises:

receiving the wireless data transmission from a traffic information service, the wireless data transmission comprising information on the location of the traffic event;

determining the current position of the vehicle; and determining that the current position of the vehicle is within a pre-defined distance of the location of the traffic event.

4. The method according to claim 1, where acquiring the image data comprises continuously acquiring the image data for a certain period of time and streaming the acquired image data for receipt by the traffic event center.

5. The method according to claim 1, further comprising the step of establishing a wireless network connection for transmitting the acquired image data for receipt by the traffic event center.

6. The method according to claim 5, where establishing the wireless network connection comprises establishing a wireless local area network connection and where transmitting the acquired image data is controlled via user input from a driver of the vehicle.

7. The method according to claim 1, where transmitting the acquired image data comprises transmitting the acquired image data via a mobile communication network.

8. The method according to claim 7, where transmitting the acquired image data comprises transmitting the acquired image data via the mobile communication network working according to at least one standard selected from the group consisting of Global System for Mobile Communications (GSM), General Packet Radio Service (GPRS), Universal Mobile Telecommunications System (UMTS), Enhanced Data rates for GSM Evolution (EDGE) and Long Term Evolution (LTE).

9. The method according to claim 1, where determining automatically that the vehicle is approaching the traffic event comprises receiving the wireless data transmission from a traffic information service provided by the traffic event center, and receiving the wireless data transmission comprises receiving the location of the traffic event from the traffic event center.

10. A vehicle traffic event monitoring system for use in a vehicle, the system comprising:

a receiving unit in the vehicle, the receiving unit adapted to receive, by a wireless data transmission, information regarding a traffic event;

an image sensor in the vehicle, the image sensor adapted to acquire image data of a vehicle environment;

an image sensor controller adapted to control a field of view of the image sensor in accordance with image control instructions received from a traffic event center;

a transmitting unit in the vehicle, the transmitting unit adapted to transmit a wireless data communication for receipt by the traffic event center; and a processing unit in the vehicle, the processing unit adapted to determine automatically if the vehicle is approaching the traffic event based on a current position of the vehicle and a location of the traffic event, the processing unit further being adapted to acquire the image data with the image sensor in response to determining that the vehicle is approaching the traffic event; and a user interface configured to retrieve a user input, where the processing unit is further adapted, depending on the user input, to selectively transmit the acquired image data with the transmitting unit and for receipt by the traffic event center.

11. The vehicle traffic event monitoring system according to claim 10, where the receiving unit is adapted to receive via the wireless data transmission the location of the traffic event, and the system further comprises a position determination unit adapted to determine the current position of the vehicle, where the processing unit is adapted to determine that the vehicle is approaching the traffic event by comparing the current position of the vehicle to the location of the traffic event.

12. The vehicle traffic event monitoring system according to claim 11, where the position determination unit comprises a Global Positioning System (GPS) sensor.

13. The vehicle traffic event monitoring system according to claim 11, where the position determination unit is configured to determine the current position of the vehicle on the basis of signals received from a mobile communications network.

14. The vehicle traffic event monitoring system according to claim 10, where the system is further configured to stream the acquired image data to the traffic event center.

15. The vehicle traffic event monitoring system according to claim 10, where the receiving unit works according to at least one standard selected from the group consisting of a Wireless Local Area Network (WLAN) standard, a mobile telephony standard, GSM, GPRS, UMTS, EDGE, LTE, Bluetooth, Digital Video Broadcasting-Terrestrial (DVBT), Radio Data System (RDS), and Traffic Message Channel (TMC).

16. The vehicle traffic event monitoring system according to claim 10, where the transmitting unit works according to at least one standard selected from the group consisting of a WLAN standard, a mobile telephony standard, GSM, GPRS, UMTS, EDGE, LTE, and Bluetooth.

17. The vehicle traffic event monitoring system according to claim 10, where the image sensor is an image sensor of a driver assistance system and comprises a camera, a 3D camera, or a photonic mixer device.

* * * * *